US009335653B2

(12) United States Patent
Otsuka

(10) Patent No.: US 9,335,653 B2
(45) Date of Patent: May 10, 2016

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Takuya Otsuka, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/631,670

(22) Filed: Feb. 25, 2015

(65) Prior Publication Data

US 2015/0309437 A1 Oct. 29, 2015

(30) Foreign Application Priority Data

Apr. 24, 2014 (JP) ..... 2014-089829

(51) Int. Cl.
*G03G 15/043* (2006.01)
*G03G 21/16* (2006.01)

(52) U.S. Cl.
CPC ..... *G03G 15/043* (2013.01); *G03G 21/1666* (2013.01); *G03G 21/1619* (2013.01)

(58) Field of Classification Search
CPC ..... G03G 15/043; G03G 21/1666; G03G 21/1619
USPC ..... 347/230, 241–245, 256–261
See application file for complete search history.

(56) References Cited

U.S. PATENT DOCUMENTS

| | | | | |
|---|---|---|---|---|
| 5,200,611 | A * | 4/1993 | Hattori | G02B 26/12 250/235 |
| 6,313,935 | B1 * | 11/2001 | Makino | 359/206.1 |
| 6,411,325 | B1 * | 6/2002 | Matsushita et al. | 347/257 |
| 6,985,312 | B2 * | 1/2006 | Yamakawa et al. | 359/819 |
| 7,072,087 | B2 * | 7/2006 | Nakahata | 359/204.1 |
| 7,355,771 | B2 * | 4/2008 | Tomita et al. | 359/205.1 |
| 7,453,616 | B2 * | 11/2008 | Shimomura | 359/206.1 |
| 7,474,451 | B2 * | 1/2009 | Yamakawa | G02B 26/124 359/216.1 |
| 7,515,322 | B2 * | 4/2009 | Suga | 359/206.1 |
| 8,207,997 | B2 * | 6/2012 | Igarashi | 347/263 |
| 8,289,600 | B2 * | 10/2012 | Yoshimura | 359/204.1 |
| 2010/0060965 | A1 * | 3/2010 | Oda | G02B 26/123 359/216.1 |

* cited by examiner

*Primary Examiner* — Sarah Al Hashimi
(74) *Attorney, Agent, or Firm* — Patterson & Sheridan, LLP

(57) ABSTRACT

According to an embodiment, an image forming apparatus includes an optical scanning apparatus. A housing cover of the optical scanning apparatus includes a light blocking member. The light blocking member blocks stray light of a laser beam emitted from the optical scanning apparatus or blocks a laser beam having a possibility to be the stray light among the laser beams emitted from the optical scanning apparatus.

9 Claims, 11 Drawing Sheets

IMAGE FORMING APPARATUS

CROSS-REFERENCE TO RELATED APPLICATION

This application is based upon and claims the benefit of priority from the prior Japanese Patent Application No. 2014-089829, filed on Apr. 24, 2014, the entire contents of which are incorporated herein by reference.

FIELD

Embodiments described herein relates generally to an image forming apparatus which employs a technology of preventing an optical scanning apparatus from emitting stray light to a latent image bearing member such as a photosensitive drum.

BACKGROUND

An image forming apparatus of an electrophotographic method includes an optical scanning apparatus. The optical scanning apparatus emits a laser beam to a latent image bearing member such as a photosensitive drum to expose an image in the latent image bearing member.

In the image forming apparatus, there may be abnormally formed an electrostatic latent image in the latent image bearing member due to stray light caused from the optical scanning apparatus.

For example, the optical scanning apparatus includes an fθ lens and a polygon mirror. The stray light may be generated when the laser beam reflected on the polygon mirror is reflected on a lens holding frame which serves to hold the fθ lens. Specifically, the lens holding frame is integrally formed in a housing of the optical scanning apparatus. The housing serves as a mounting substrate of an optical component of an optical scanning apparatus 20. The lens holding frame is disposed to abut on both end surfaces in a longitudinal direction of the elongated fθ lens. The reflected light from the polygon mirror is incident on the end surface in the longitudinal direction of the fθ lens, the incident light is reflected on the end surface of the fθ lens and emitted therefrom, and the emitted light becomes the stray light and is emitted to the latent image bearing member.

As a countermeasure against the stray light, for example, in an incident surface of the fθ lens on which the reflected light from the polygon mirror is incident or an emitting surface, the housing is provided with a light-blocking wall which covers an area causing the stray light. Further, in the incident surface or the emitting surface, the housing is attached by a light-blocking sheet in the area causing the stray light.

On the other hand, in the automatic assembly of the optical scanning apparatus, there is a need to provide a jig to hold the fθ lens in order to position the fθ lens. However, in a case where the fθ lens is automatically assembled in the housing, the light-blocking wall provided in the housing interferes with the jig, so that it becomes difficult to dispose the light-blocking wall for preventing the stray light.

DETAILED DESCRIPTION

Figure 1:
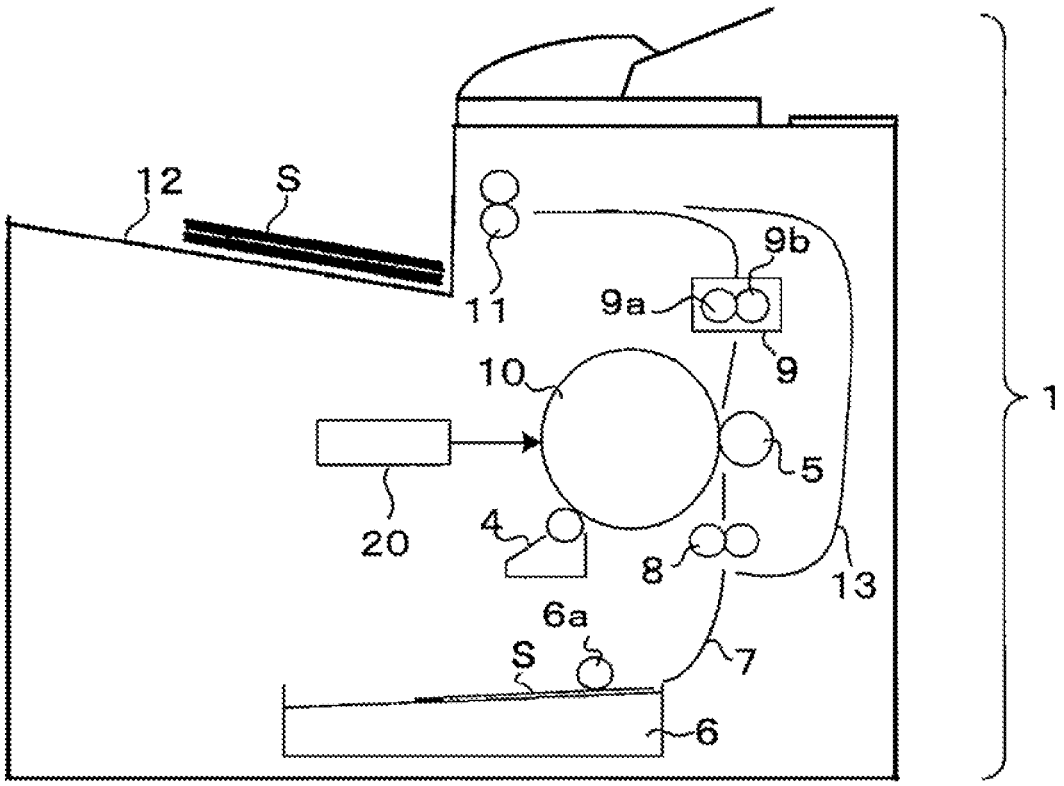
FIG. 1 is a cross-sectional view illustrating main components of an image forming apparatus according to a first embodiment.

According to an embodiment, an image forming apparatus includes an optical scanning apparatus which emits a laser beam to scan a latent image bearing member and forms an electrostatic latent image in the latent image bearing member. Further, the image forming apparatus includes a casing and a light blocking member. The casing includes a housing serving as a substrate on which components of an optical scanning portion are mounted and a housing cover which is mounted on the housing to cover the housing. The light blocking member is provided in the housing cover, and blocks stray light of the laser beam emitted from the optical scanning apparatus or blocks a laser beam having a possibility to be the stray light among the laser beams emitted from the optical scanning apparatus.

Hereinafter, another embodiment will be described with reference to the drawings. In the drawings, the same symbols indicate the identical or similar portions.

Figure 2A:
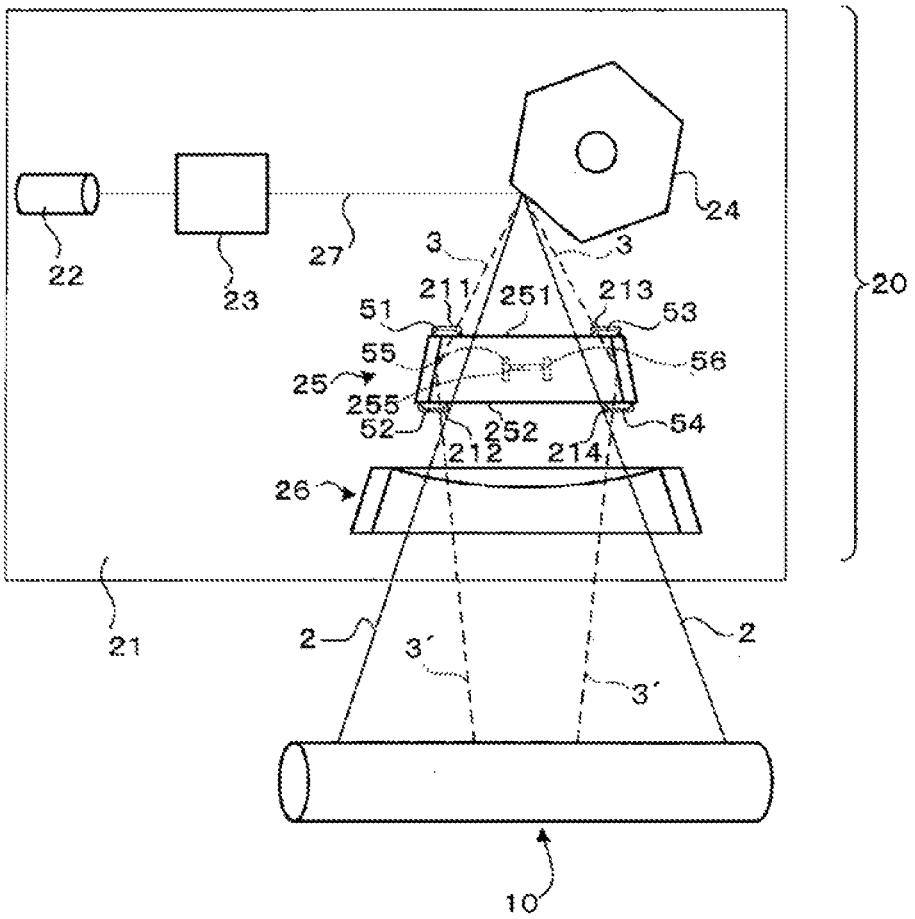
FIG. 2A is a diagram illustrating a state where an fθ lens of an optical scanning apparatus used in the image forming apparatus according to the first embodiment is in an assembly process.
Figure 2B:
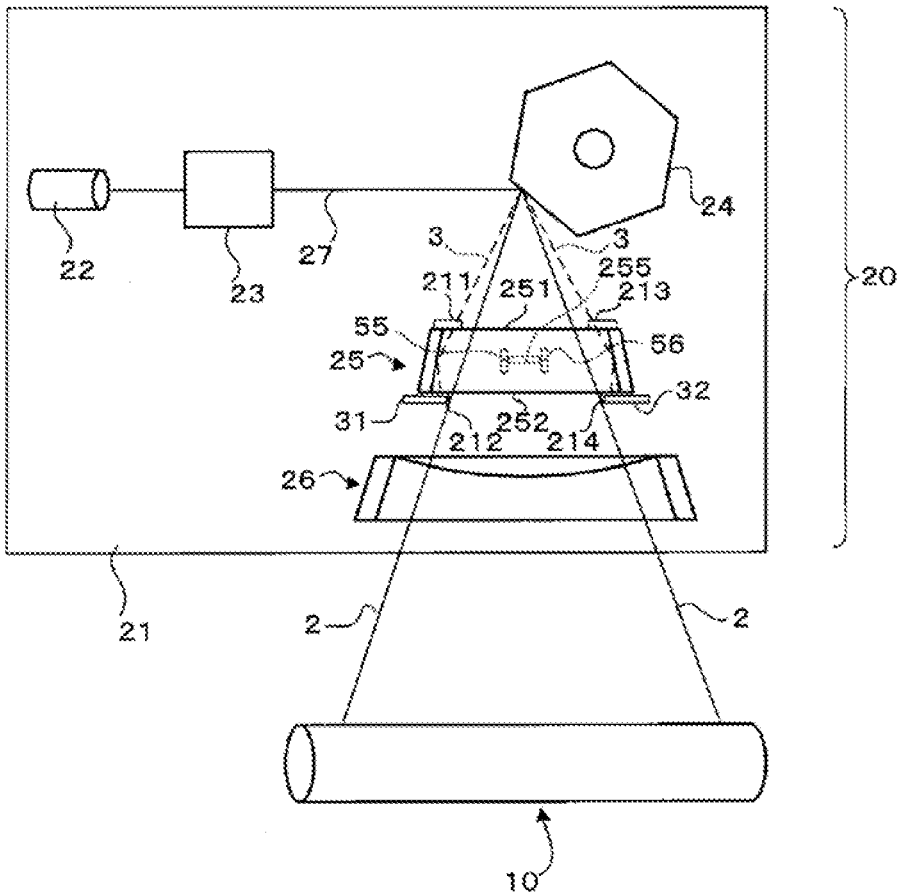
FIG. 2B is a diagram illustrating an assembled state of the fθ lens of the optical scanning apparatus used in the image forming apparatus according to the first embodiment.

An image forming apparatus according to the first embodiment will be described with reference to FIGS. 1, 2A, and 2B. FIG. 1 is a cross-sectional view illustrating main components of the image forming apparatus of the first embodiment. FIG. 2A is a diagram illustrating a state where an fθ lens of the optical scanning apparatus used in the image forming apparatus according to a first embodiment is in an assembly process. FIG. 2B is a diagram illustrating the assembled state of the fθ lens of the optical scanning apparatus used in the image forming apparatus according to the first embodiment.

An image forming apparatus 1 forms a toner image in a sheet S using an electrophotographic method. As illustrated in FIG. 1, the image forming apparatus 1 includes a photosensitive drum 10, an optical scanning apparatus 20, a developing unit 4, a transfer roller 5, a sheet cassette 6, a sheet feeding roller 6*a*, a conveyance path 7, and a registration roller 8. The photosensitive drum 10 is a latent image bearing member which rotates while bearing the electrostatic latent image formed in the surface thereof. The optical scanning apparatus 20 scans the photosensitive drum 10 by emitting the laser beam so as to expose the photosensitive drum 10. The optical scanning apparatus 20 performs the exposure to form the electrostatic latent image in the photosensitive drum 10. The developing unit 4 contains toner as a developer. The developing unit 4 develops the electrostatic latent image using the toner to form the toner image in the photosensitive drum 10, so that the electrostatic latent image is visualized. The transfer roller 5 abuts on the photosensitive drum 10 and forms a nip portion as a transfer position. The transfer roller 5 transfers the toner image at the transfer position from the photosensitive drum 10 onto the sheet S serving as a recording medium. The sheet cassette 6 is detachably attached to the image forming apparatus 1. The sheet cassette 6 stores the sheets S. The sheet feeding roller 6*a* ejects the sheets S one by one out of the sheet cassette 6 and the ejected sheet is conveyed to the conveyance path 7. The conveyance path 7 guides the conveyed sheet S to the registration roller 8 and the transfer position. The registration roller 8 conveys the sheet S to the transfer position in synchronization with timing for forming the toner image.

The image forming apparatus 1 further includes a fixing device 9, a sheet discharge roller 11, a sheet discharge tray 12, and a reverse conveyance path 13. The fixing device 9 includes a heating roller 9*a* and a pressing roller 9*b*. The heating roller 9*a* and the pressing roller 9*b* abut on each other and form the nip portion for fixing. The heating roller 9*a* and the pressing roller 9*b* heat and press the toner image (an unfixed toner image) which is transferred on the sheet S conveyed to the nip portion for fixing, and thus the toner image is fixed onto the sheet S. The sheet discharge roller 11 discharges the fixed sheet S to the outside of the image forming apparatus 1. The sheet discharge tray 12 receives the discharged sheet S. Further, in the case of duplex printing (for example, two-sided copy), the sheet discharge roller 11 switches a conveyance direction of the sheet S by a switching member (not illustrated) to convey the fixed sheet S to the reverse conveyance path 13. The reverse conveyance path 13 reverses the face of the conveyed sheet S, and guides the sheet S to the registration roller 8 again.

Hereinafter, the optical scanning apparatus 20 will be described with reference to FIGS. 2A and 2B. FIG. 2A is a diagram illustrating a state where the fθ lens of the optical scanning apparatus 20 is in an assembly process. FIG. 2B is a diagram illustrating the assembled state of the fθ lens of the optical scanning apparatus 20. As illustrated in FIG. 2A, the optical scanning apparatus 20 includes a casing which includes a housing 21 and a housing cover 30 described below. The housing 21 serves as a mounting substrate for mounting optical components of the optical scanning apparatus 20. The housing cover 30 is mounted on the housing 21, and covers the upper surface of the housing 21. The optical scanning apparatus 20 further includes the optical components such as a semiconductor laser 22, a collective lens 23, a polygon mirror 24, a first fθ lens 25 to which a specific amount of barrel distortion aberration is added, and a second fθ lens 26 to which a specific amount of barrel distortion aberration is added. These optical components are disposed in the housing 21. In other words, the housing 21 contains these optical components.

The semiconductor laser 22 emits a laser beam 27. The collective lens 23 condenses the laser beam 27 emitted from the semiconductor laser 22 onto a reflecting surface of the polygon mirror 24. The polygon mirror 24 reflects the laser beam 27 while rotating in a predetermined direction, so that the laser beam 27 is emitted onto the photosensitive drum 10 through the first fθ lens 25 and the second fθ lens 26. The polygon mirror 24 emits the laser beam 27 onto the photosensitive drum 10, so that the photosensitive drum 10 is exposed and scanned.

A scanning light beam 2 depicted by the solid line in FIG. 2A is not reflected on a side end surface of the first fθ lens 25 but advanced, so that no stray light is generated. In this regard, a scanning light beam 3 depicted by the broken line in FIG. 2A is reflected on the side surfaces on both end sides of the first fθ lens 25, so that the reflected light becomes stray light 3'. The photosensitive drum 10 is exposed and scanned by the stray light 3'.

Specifically, the polygon mirror 24, for example, rotates in the counterclockwise direction, so that the laser beam 27 emitted from the semiconductor laser 22 and incident onto the polygon mirror 24 is reflected to the first fθ lens 25. The polygon mirror 24 performs scanning such that the reflected light beam (the scanning light beam) is emitted to advance toward an incident surface 251 of the first fθ lens 25 from one end in a longitudinal direction of the first fθ lens 25 to the other end (from the left end to the right end in the drawing). In other words, the reflected light (the scanning light beam) from the polygon mirror 24 is incident on the first fθ lens 25 to scan the incident surface 251 of the first fθ lens 25 from the one end to the other end in the longitudinal direction. Therefore, the scanning light beam incident from the one end (the left end in the drawing) in the longitudinal direction of the incident surface 251 of the first fθ lens 25 is reflected on the side surface on the one end side in the longitudinal direction of the first fθ lens 25 until a predetermined position of the incident surface 251 of the first fθ lens 25 is scanned. The scanning light beam 3 reflected on the side surface on the one end side in the longitudinal direction of the first fθ lens 25 becomes the stray light 3'. The scanning light beam 2 passing in excess of the predetermined position on the one end side in the longitudinal direction is emitted from a light emitting surface 252 without reflection on the side surface on the one end side in the longitudinal direction of the first fθ lens 25. Furthermore, when the scanning light beam 2 reaches a predetermined position on the other end side (the right end in the drawing) in the longitudinal direction of the incident surface 251 of the first fθ lens 25, the scanning light beam 2 is reflected on the side surface on the other end side in the longitudinal direction of the first fθ lens 25. The scanning light beam 3 reflected on the other end side in the longitudinal direction of the first fθ lens 25 becomes the stray light 3'.

Therefore, the scanning light beam 3 incident until it passes in excess of the predetermined position on the one end side in the longitudinal direction of the incident surface 251 of the first fθ lens 25, and the scanning light beam 3 incident until it reaches the other end (the right end in the drawing) of the first fθ lens 25 from the predetermined position on the other end side in the longitudinal direction of the incident surface 251 of the first fθ lens 25 are the laser beams becoming the stray light 3'. Therefore, the scanning light beam 3 is blocked from being incident on the incident surface of the first fθ lens 25 between the one end in the longitudinal direction of the incident surface 251 of the first fθ lens 25 and a predetermined position and between a predetermined position on the other end side in the longitudinal direction and the other end of the first fθ lens 25, so that it is possible to prevent the occurrence of the stray light 3'.

Furthermore, the stray light 3' emitting from both end portions in the longitudinal direction of the light emitting surface 252 of the first fθ lens 25 is blocked, so that it is possible to prevent the photosensitive drum 10 from being exposed to the stray light 3'. The photosensitive drum 10 is prevented from being exposed to the stray light 3', so that the electrostatic latent image can be formed in the photosensitive drum 10 without any influence of the stray light 3'.

In this embodiment, the collective lens 23, the first fθ lens 25, and the second fθ lens 26 which are disposed in the housing 21 are assembled according to an automatic assembling method. The automatic assembly is performed by inserting component holding claws (described below) protruding from the jig board into jig insertion ports 211 to 214 (described below) formed at predetermined positions of the housing 21 when the housing 21 is placed at a predetermined position on a jig board (not illustrated).

As illustrated in FIG. 2A, on one end sides of the incident surface 251 and the light emitting surface 252 which are long sides of the first fθ lens 25, a first holding claw 51 and a second holding claw 52 are disposed to face each other. Furthermore, as illustrated in FIG. 2A, on the other end sides of the incident surface 251 and the light emitting surface 252 which are the long sides of the first fθ lens 25, a third holding claw 53 and a fourth holding claw 54 are disposed to face each other. Specifically, the housing 21 includes the jig insertion ports 211 to 214 for the fθ lens. The jig insertion ports 211 to 214 are provided in the bottom of the housing 21 in correspondence with layout positions of the light blocking members (described below). The first holding claw 51, the second holding claw 52, the third holding claw 53, and the fourth holding claw 54 are provided to protrude from the jig board. When the housing 21 is placed at a predetermined position on the jig board, the first holding claw 51, the second holding claw 52, the third holding claw 53, and the fourth holding claw 54 are inserted into the jig insertion ports 211 to 214 for the fθ lens and protrude from the housing 21. The first holding claw 51 and the second holding claw 52 form a first holding portion to face the short side of the first fθ lens 25. The third holding claw 53 and the fourth holding claw 54 form a second holding portion to face the short side of the first fθ lens 25.

The positioning in a direction (the vertical direction of FIGS. 2A and 2B) perpendicular to the longitudinal direction of the first fθ lens 25 will be described with reference to FIGS. 2A and 2B. The both end portions in the longitudinal direction of the first fθ lens 25 are held by the first and second holding portions which include the first holding claw 51, the second holding claw 52, the third holding claw 53, and the fourth holding claw 54. The first fθ lens 25 is held by the first and second holding portions, so that the positioning in the direction perpendicular to the longitudinal direction is determined.

Figure 9:
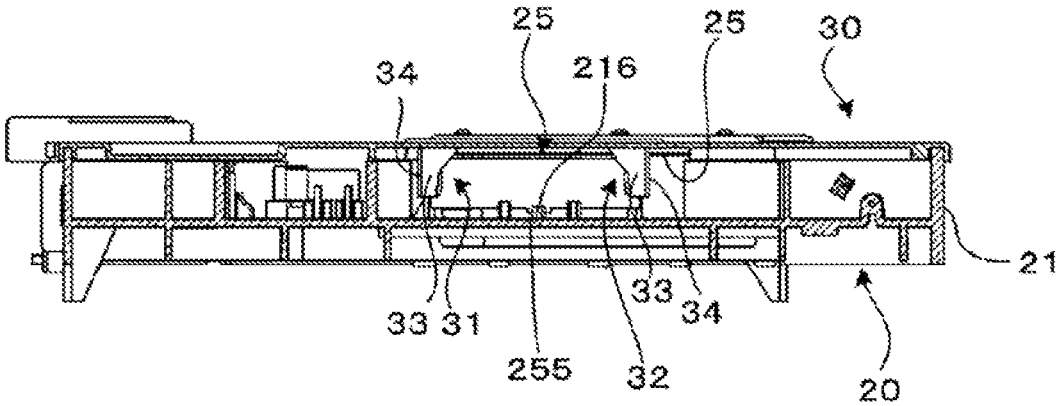
FIG. 9 is a cross-sectional view illustrating the housing in a case where the housing of the optical scanning apparatus used in the image forming apparatus according to the first embodiment is taken along line A-A of FIG. 8.
Figure 10:
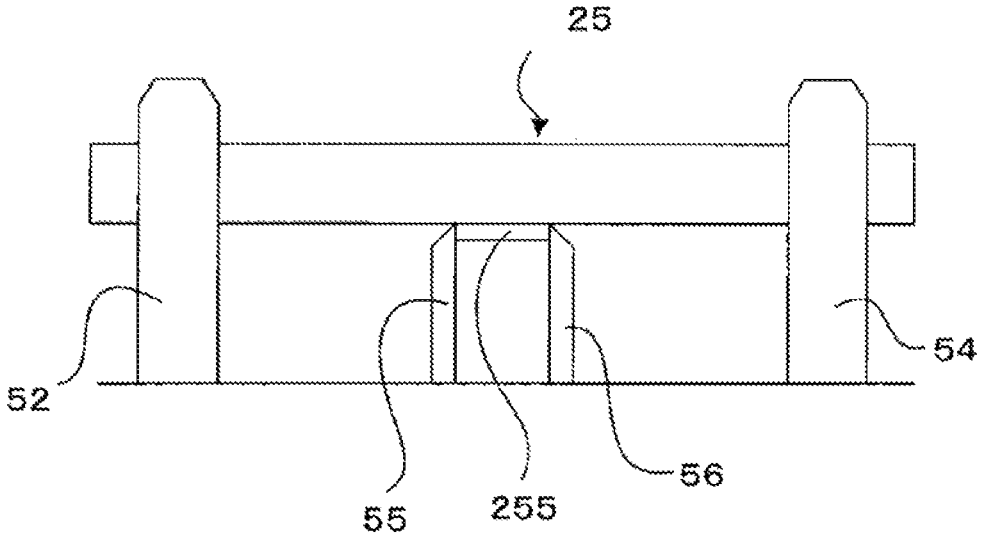
FIG. 10 is a front view for describing that a first fθ lens is positioned by a jig in the housing of the optical scanning apparatus used in the image forming apparatus according to the first embodiment, in which the first fθ lens is viewed from a light emitting surface.

The positioning in the longitudinal direction (the horizontal direction of FIGS. 2A and 2B) of the first fθ lens 25 will be described with reference to FIGS. 2A, 2B, and 10. FIG. 10 is a front view in a case where the first fθ lens is viewed from the light emitting surface. The first fθ lens 25 includes a positioning protrusion 255. The positioning protrusion 255 is an elongated protrusion which protrudes along the longitudinal direction (for example, the horizontal direction of FIGS. 2A and 10) of the first fθ lens 25, and toward a direction perpendicular to the longitudinal direction (a rear direction of FIG. 2A to the sheet) in a bottom surface of the first fθ lens 25 (see FIGS. 2A, 2B, 3, 5, 7, 9, and 10). In the jig board, as illustrated in FIG. 10, a first positioning engagement portion 55 and a second positioning engagement portion 56 are disposed at predetermined positions between the first and second holding portions to face each other in the longitudinal direction, and protrude up to a height for engagement with the positioning protrusion 255. A facing interval between the first positioning engagement portion 55 and the second positioning engagement portion 56 corresponds to a length (a length in the horizontal direction of FIG. 2A) of the positioning protrusion 255.

Therefore, as illustrated in FIG. 10, the first fθ lens 25 falls down from the upside in FIG. 10 such that the positioning protrusion 255 of the first fθ lens 25 is engaged between the first positioning engagement portion 55 and the second positioning engagement portion 56. The first fθ lens 25 is positioned in the longitudinal direction such that the positioning protrusion 255 of the first fθ lens 25 is engaged between the first positioning engagement portion 55 and the second positioning engagement portion 56.

The first holding claw 51 and the third holding claw 53 are disposed at positions where the scanning light beam 3 having a possibility to be the stray light depicted by the broken line is incident on the first fθ lens 25. Furthermore, the second holding claw 52 and the fourth holding claw 54 are disposed at positions where the stray light 3' is emitted. The jig insertion ports 211 to 214 are formed at the positions where the first to fourth holding claws 51 to 54 are disposed. Therefore, a light-blocking wall portion serving to block the stray light is not able to be formed at the positions of the jig insertion ports 211 to 214 on the housing 21.

In this regard, in the embodiment, light-blocking wall portions 31 and 32 as light blocking members to block the stray light 3' are provided at positions corresponding to the first fθ lens 25 in the inner surface side of the housing cover 30. The light-blocking wall portions 31 and 32 are formed integrally with the housing cover 30 (see FIGS. 6 and 9). The light-blocking wall portions 31 and 32, for example, are provided at positions corresponding to the light emitting surface 252 of the first fθ lens 25 on the inner surface side of the housing cover 30. For example, as illustrated in FIG. 2B, when the housing cover 30 is mounted on the housing 21 after the optical components are installed in the housing 21, the light-blocking wall portions 31 and 32 are positioned in the both end portions of the light emitting surface 252 of the first fθ lens 25. The light-blocking wall portions 31 and 32 prevent the stray light 3' from being emitted from the light emitting surface 252 of the first fθ lens 25. The light-blocking wall portions 31 and 32 provided in the housing cover 30 are disposed on the light emitting surface 252 of the first fθ lens 25 corresponding to the positions where the stray light 3' is emitted, but the invention is not limited to this arrangement. For example, the light-blocking wall portions 31 and 32 provided in the housing cover 30 may be disposed on the incident surface 251 of the first fθ lens 25 corresponding to the positions where the scanning light beam 3 having a possibility to be the stray light is incident.

Figure 3:
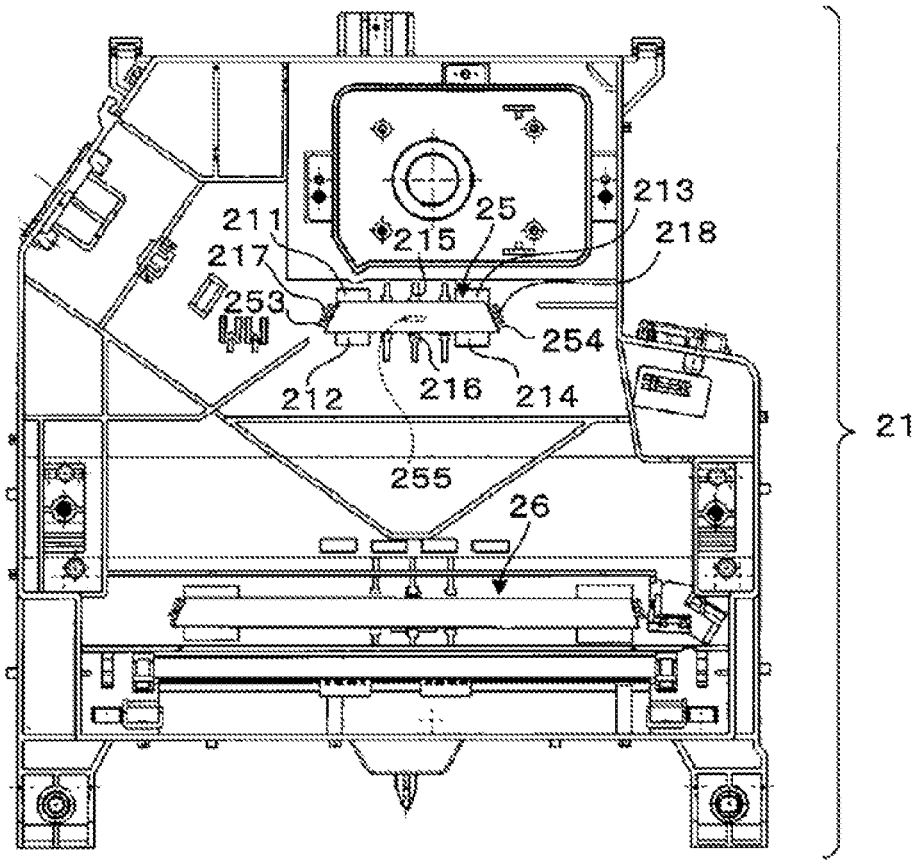
FIG. 3 is a top view illustrating a configuration of a housing of the optical scanning apparatus in the assembled state of the fθ lens in the optical scanning apparatus used in the image forming apparatus according to the first embodiment.
Figure 4:
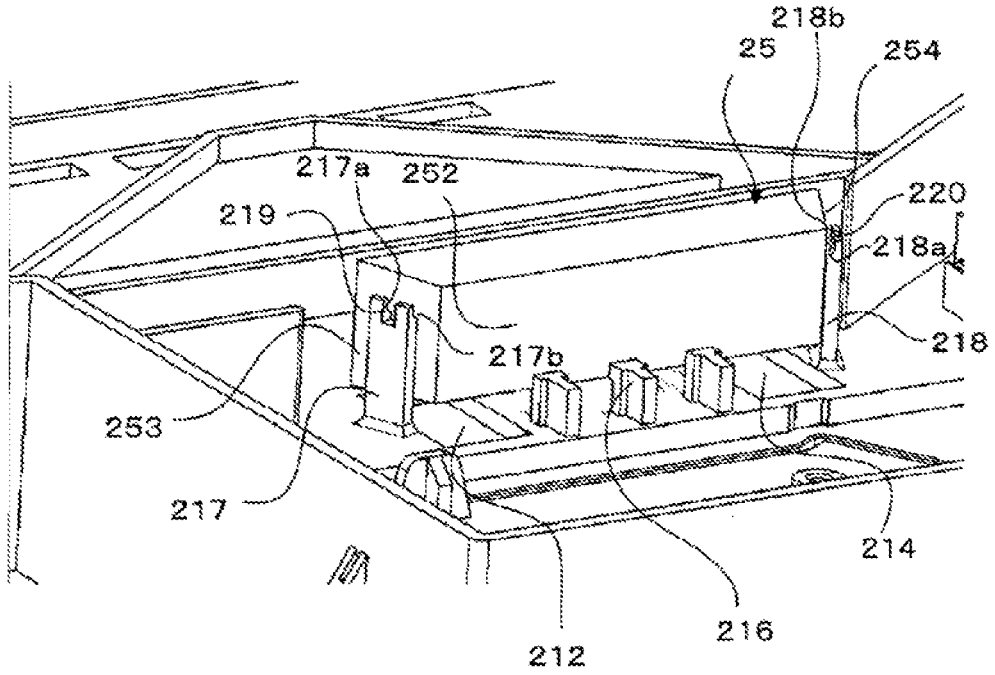
FIG. 4 is a perspective view illustrating the fθ lens of the optical scanning apparatus used in the image forming apparatus according to the first embodiment.
Figure 5:
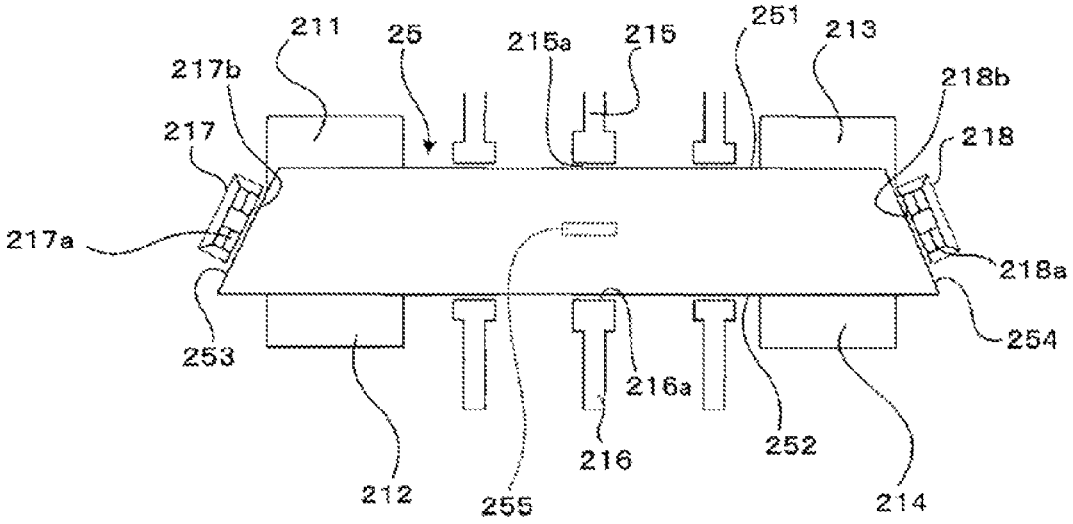
FIG. 5 is a top view illustrating the fθ lens of the optical scanning apparatus used in the image forming apparatus according to the first embodiment and the surrounding portion thereof on an enlarged scale.

A detailed configuration of the housing 21 will be described with reference to FIGS. 3 to 5. FIG. 3 is a top view illustrating a configuration of the housing 21 in a state where the first fθ lens 25 is assembled. FIG. 4 is a perspective view illustrating the first fθ lens 25 and the surrounding portion thereof. FIG. 5 is a top view illustrating the first fθ lens 25 and the surrounding portion thereof on an enlarged scale. Further, in FIGS. 3 to 5, the description will be made only about the configuration for mounting the first fθ lens 25, and the other configurations for mounting other optical components will not be described.

For example, as illustrated in FIG. 3, the jig insertion ports 211 to 214 are formed in a bottom plate portion of the housing 21. The jig insertion ports 211 and 213 are formed in the bottom plate portion of the housing 21 to face the incident surface 251 of the first fθ lens 25. The jig insertion ports 212 and 214 are formed in the bottom plate portion of the housing 21 to face the light emitting surface 252 of the first fθ lens 25.

As illustrated in FIGS. 3 to 5, the housing 21 includes a first lens supporting protrusion 215 and a second lens supporting protrusion 216 as lens incident/emitting surface support members. The first lens supporting protrusion 215 is provided between the jig insertion ports 211 and 213 in the bottom of the housing 21 to face the incident surface 251 of the first fθ lens 25 and to protrude by a predetermined height. The second lens supporting protrusion 216 is provided between the jig insertion ports 212 and 214 in the bottom of the housing 21 to face the light emitting surface 252 of the first fθ lens 25 and to protrude by a predetermined height. Furthermore, as illustrated in FIG. 5, first gaps 215*a* and 216*a* are provided between the first lens supporting protrusion 215 and the incident surface 251 of the first fθ lens 25 and between the second lens supporting protrusion 216 and the light emitting surface 252 of the first fθ lens 25. In other words, the housing 21 includes the first and second lens supporting protrusions in the incident surface 251 and the light emitting surface 252 of the first fθ lens 25 through the first gaps 215*a* and 216*a*. The first gaps 215*a* and 216*a* are filled with an adhesive. Therefore, the first fθ lens 25 is adhesively supported to the first and second lens supporting protrusions 215 and 216 by the adhesive which fills the first gaps 215*a* and 216*a*.

The heights of the first lens supporting protrusion 215 and the second lens supporting protrusion 216 are set to heights having no influence on incidence and emission of the scanning light beam which passes through the first fθ lens 25.

As illustrated in FIGS. 3 to 5, the housing 21 further includes a first side surface supporting portion 217 and a second side surface supporting portion 218 as lens side-surface support members. The first side surface supporting portion 217 is formed in the bottom of the housing 21 to face an end surface 253 at one end of the first fθ lens 25 and to extend upward (a surface direction of FIGS. 3 and 5 to the sheet). The second side surface supporting portion 218 is formed in the bottom of the housing 21 to face an end surface 254 at the other end in the longitudinal direction of the first fθ lens 25 and to extend upward (the surface direction of FIGS. 3 and 5 to the sheet). As illustrated in FIG. 4, the ends of the first side surface supporting portion 217 and the second side surface supporting portion 218 reach up to a position slightly lower than the top surfaces of both end surfaces 253 and 254 of the first fθ lens 25. In other words, the heights of the first side surface supporting portion 217 and the second side surface supporting portion 218 are slightly smaller than the heights of both end surfaces 253 and 254 of the first fθ lens 25. Second gaps 217*b* and 218*b* are provided between the first side surface supporting portion 217 and the end surface 253 of the first fθ lens 25 and between the second side surface supporting portion 218 and the end surface 254 of the first fθ lens 25. In other words, the housing 21 includes the first side surface supporting portion 217 and the second side surface supporting portion 218 in the both end portions in the longitudinal direction of the first fθ lens 25 through the second gaps 217*b* and 218*b*. The second gaps 217*b* and 218*b* are provided to allow the positioning in the longitudinal direction. The second gaps 217*b* and 218*b* are filled with an adhesive through adhesive collecting portions 217*a* and 218*a* (described below). Therefore, the first fθ lens 25 is adhesively supported to the first side surface supporting portion 217 and the second side surface supporting portion 218 by the adhesive which fills the second gaps 217*b* and 218*b*.

As illustrated in FIGS. 4 and 5, the first side surface supporting portion 217 and the second side surface supporting portion 218 includes the adhesive collecting portions 217*a* and 218*a*. The adhesive collecting portions 217*a* and 218*a* are formed in the upper end portions of the first side surface supporting portion 217 and the second side surface supporting portion 218. The first side surface supporting portion 217 and the second side surface supporting portion 218 are disposed such that the adhesive collecting portions 217*a* and 218*a* face both end surfaces 253 and 254 of the first fθ lens 25. Furthermore, as illustrated in FIG. 4, the first side surface supporting portion 217 and the second side surface supporting portion 218 include notch portions 219 and 220. The notch portions 219 and 220 are formed on the outer surface sides of the upper portions of the first side surface supporting portion 217 and the second side surface supporting portion 218. The notch portions 219 and 220 communicate with the adhesive collecting portions 217*a* and 218*a*.

In the embodiment, the first fθ lens 25 is bonded to the housing with an adhesive after the assembling of the first fθ lens 25. The bonding operation is performed using the adhesive by filling the predetermined gap 215*a* formed between the incident surface 251 of the first fθ lens 25 and the first lens supporting protrusion 215, and the predetermined gap 216*a* formed between the light emitting surface 252 of the first fθ lens 25 and the second lens supporting protrusion 216. Further, the bonding operation is performed using the adhesive by filling each of the adhesive collecting portions 217*a* and 218*a* from the notch portions 219 and 220 in the upper portions of the first side surface supporting portion 217 and the second side surface supporting portion 218.

Figure 6:
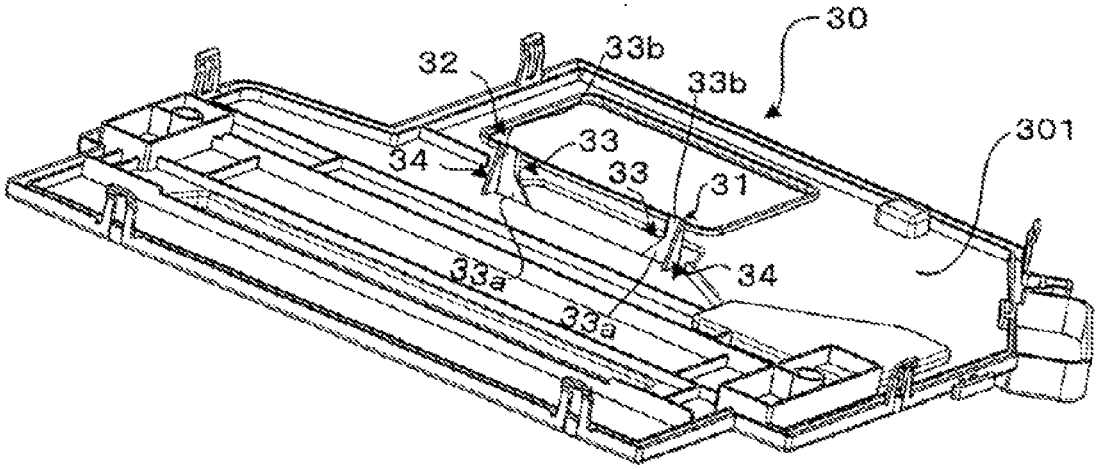
FIG. 6 is a perspective view illustrating the inside of a housing cover put on the housing of the optical scanning apparatus used in the image forming apparatus according to the first embodiment, in which the inside of the cover is disposed upward.
Figure 7:
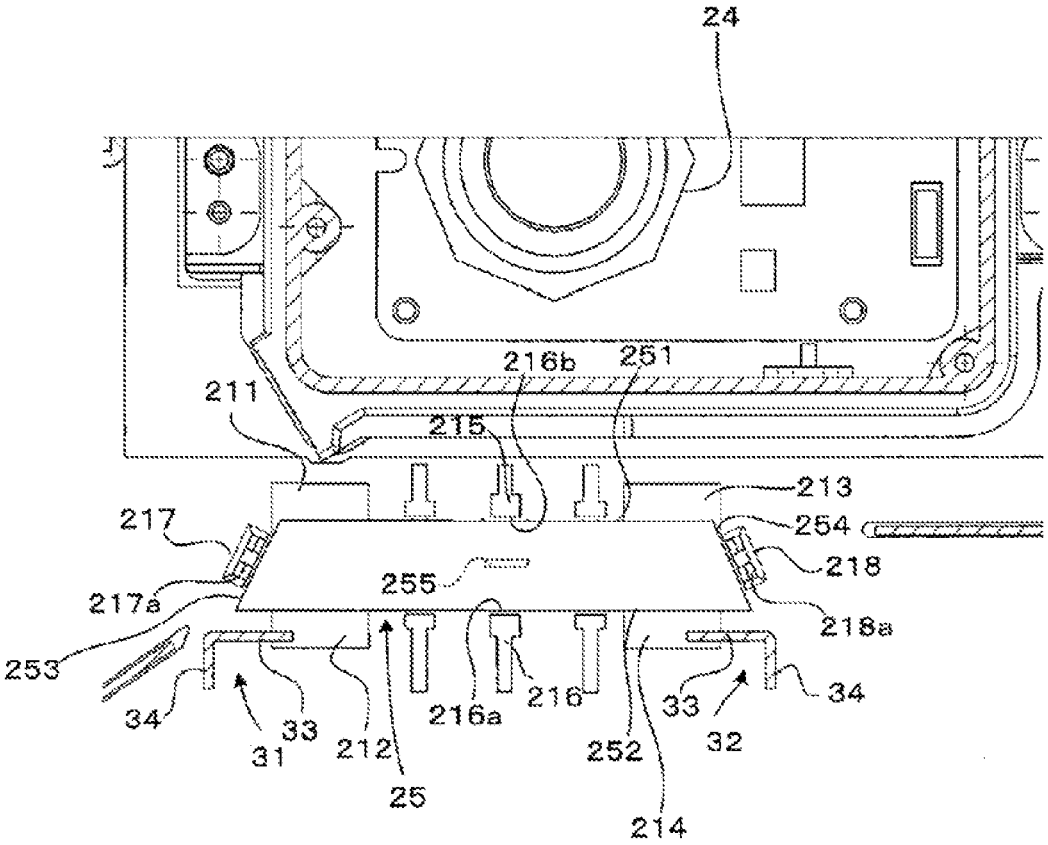
FIG. 7 is a top view illustrating a relation between a stray light blocking member provided in the housing cover of the optical scanning apparatus used in the image forming apparatus according to the first embodiment and the fθ lens.
Figure 8:
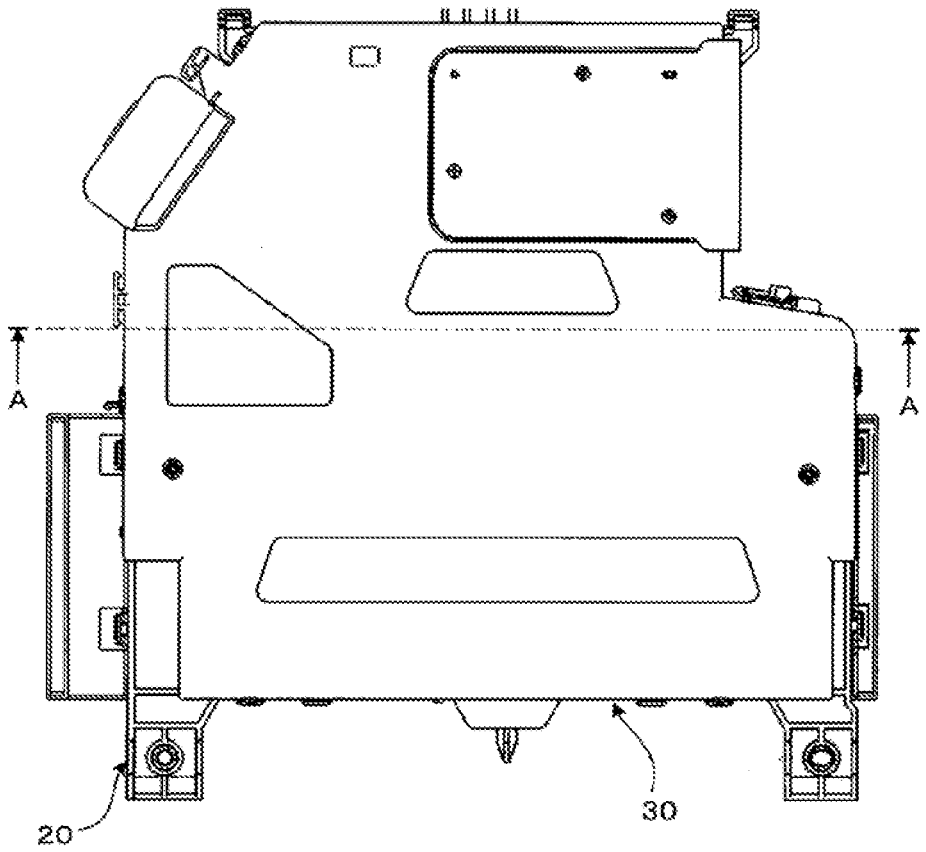
FIG. 8 is a top view illustrating a state of the housing cover put on the housing of the optical scanning apparatus used in the image forming apparatus according to the first embodiment.

The housing cover 30 will be described with reference to FIGS. 6 to 9. FIG. 6 is a perspective view illustrating a state where the inner surface side of the housing cover 30 is disposed upward. FIG. 7 is a diagram illustrating layout positions of the light-blocking wall portions 31 and 32 when the housing cover 30 is mounted on the housing 21. FIG. 8 is a top view illustrating the housing 21 in a state where the housing cover 30 is mounted. FIG. 9 is a cross-sectional view illustrating the housing 21 illustrated in FIG. 8 taken along line A-A in FIG. 8.

The housing cover 30 includes the light-blocking wall portions 31 and 32. The light-blocking wall portions 31 and 32 have a non-transmissive property. The light-blocking wall portions 31 and 32 are formed integrally with a ceiling 301 of the housing cover 30. The light-blocking wall portions 31 and 32 include a light-blocking wall body 33 and a rib 34. The light-blocking wall portions 31 and 32 are configured such that the light-blocking wall body 33 is supported by the rib 34, and the horizontal cross section is an approximate L shape. The light-blocking wall body 33 is disposed to be parallel to the light emitting surface of the first fθ lens 25 when the housing cover 30 is mounted on the housing 21. Furthermore, as illustrated in FIG. 6, the light-blocking wall body 33 includes a first wall 33*a* and a second wall 33*b*. The first wall 33*a* is provided on the ceiling. The second wall 33*b* is consecutively connected to the lower portion of the first wall 33*a*. The first wall 33*a* and the second wall 33*b* include inner end surfaces which face each other. The inner end surface of the first wall 33*a* is formed in a straight line along the vertical direction. The inner end surface of the first wall 33*a* is formed in an inclined shape further extending to the inside (a direction where the first wall 33*a* and the second wall 33*b* face each other) from the inner end surface of the second wall 33*b* so as to be matched with the external shape of the end surface in the longitudinal direction of the first fθ lens 25. In other words, the inner end surface of the first wall 33*a* has an inclined surface which is matched with the external shape of the end surface in the longitudinal direction of the first fθ lens 25.

Further, in the image forming apparatus, the scanning and exposure (reading) laser beam (the scanning light beam) passes through the first fθ lens 25 and the second fθ lens 26 and is detected by a photo sensor (not illustrated) for detecting a laser beam synchronization through a mirror (not illustrated) disposed in the housing 21. Even the photo sensor for detecting the laser beam synchronization may be configured such that the light-blocking wall portion for blocking the stray light similarly to the first fθ lens 25 is disposed in the housing cover 30. Furthermore, even the mirror serving to guide the scanning and exposure laser beam to the photo sensor for detecting the laser beam synchronization may be configured such that the light-blocking wall portion for blocking the stray light similarly to the first fθ lens 25 is disposed in the housing cover 30. Since the light-blocking wall portion is provided in the mirror, it is possible to block the stray light generated at the edge or the side surface of the mirror.

According to the embodiment, in a case where the optical scanning apparatus 20 is configured according to the automatic assembly, the light blocking member such as the light-blocking wall portion is provided to previously block the laser beam having a possibility to be the stray light or block the emission of the stray light in the housing cover 30 configuring the casing of the optical scanning apparatus 20. Therefore, it is possible to perform the automatic assembly on the optical scanning apparatus without any trouble.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus which includes an optical scanning apparatus, the optical scanning apparatus scanning a latent image bearing member by emitting a laser beam to form an electrostatic latent image on the latent image bearing member, the image forming apparatus comprising:

an optical scanning section which includes a scanning mirror and a fθ lens;

a housing which includes a jig insertion port in which a jig which supports the fθ lens temporarily at both ends of the fθ lens in a longitudinal direction is inserted into the housing for mounting the fθ lens, the jig being removed after the fθ lens is mounted in the housing;

a housing cover which is mounted on the housing to cover the housing; and a light blocking member which is provided in the housing cover, the light blocking member arranged in a position corresponding to the jig insertion port at both ends of the fθ lens in the longitudinal direction, and configured to block at least some laser light emitted from the optical scanning apparatus that is reflected directly off of the scanning mirror and block stray light emitted from the optical scanning apparatus that is reflected off of a support of the fθ lens, when the housing cover is mounted on the housing.

2. The image forming apparatus according to claim 1, wherein the light blocking member is provided in the housing cover at a position corresponding to a light emitting surface of the fθ lens or an incident surface.

3. The image forming apparatus according to claim 1, wherein the fθ lens includes a positioning protrusion on a bottom surface, and the positioning protrusion engages the jig to perform positioning in the longitudinal direction of the fθ lens when the fθ lens is inserted into the housing for mounting.

4. The image forming apparatus according to claim 3, wherein the housing includes a lens incident/emitting surface support member in an incident surface and a light emitting surface of the fθ lens through a first gap.

5. The image forming apparatus according to claim 4, wherein the housing includes a lens side-surface support member in an end portion in the longitudinal direction of the fθ lens through a second gap.

6. The image forming apparatus according to claim 5, wherein the fθ lens is adhesively supported to the respective support members by an adhesive which fills the first and second gaps.

7. The image forming apparatus according to claim 1, wherein the light blocking member is provided with the housing cover in a position corresponding to a light emitting surface of the fθ lens and configured to block the stray light emitted from the optical scanning apparatus that is reflected off of the support of the fθ lens.

8. The image forming apparatus according to claim 7, wherein the stray light blocked by the light blocking member blocks is reflected off of the support at an end position in the longitudinal direction of the fθ lens.

9. The image forming apparatus according to claim 1, wherein the light blocking member is provided in the housing cover in a position corresponding to an incident surface of the fθ lens to block the at least some laser light emitted from the optical scanning apparatus that is reflected directly off of the scanning mirror.

* * * * *